US010695894B2

(12) United States Patent
Shen

(10) Patent No.: US 10,695,894 B2
(45) Date of Patent: Jun. 30, 2020

(54) RATCHET HANDLE

(71) Applicant: Guo Sun Shen, Taichung (TW)

(72) Inventor: Guo Sun Shen, Taichung (TW)

( * ) Notice: Subject to any disclaimer, the term of this patent is extended or adjusted under 35 U.S.C. 154(b) by 151 days.

(21) Appl. No.: 16/101,461

(22) Filed: Aug. 12, 2018

(65) Prior Publication Data

US 2020/0047317 A1 Feb. 13, 2020

(51) Int. Cl.
*B25B 13/46* (2006.01)
*B25B 13/06* (2006.01)

(52) U.S. Cl.
CPC ..... *B25B 13/463* (2013.01); *B25B 13/06* (2013.01)

(58) Field of Classification Search
CPC ..... B25B 13/463; B25B 13/468; B25B 13/06
See application file for complete search history.

(56) References Cited

U.S. PATENT DOCUMENTS 5,090,273 A * 2/1992 Fossella ..... B25B 13/44 81/57.13
2013/0228048 A1* 9/2013 Lai ..... B25B 13/463 81/63.1
2016/0008960 A1* 1/2016 Chen ..... B25B 13/468 81/58.4

FOREIGN PATENT DOCUMENTS

FR 2843323 A3 * 2/2004 ..... B25B 13/463

* cited by examiner

*Primary Examiner* — Daniel J Colilla

(57) ABSTRACT

A ratchet handle contains: a body, a driving head, a first accommodation chamber and a second accommodation chamber separated by a partition, a first opening, a second opening, a connector. A connector has a ratchet, two actuation members, and two toothed portions, the first opening accommodates a press member which has two operation portions, two balls, a shaft, and a driving sheet. The first accommodation chamber has a covering sheet, and the covering sheet includes a first orifice, a second orifice, a notch, two tabs, a first recess, and a second recess, wherein each of the two balls abuts against the first recess or the second recess. The first accommodation chamber has the covering sheet received therein, and a bottom of the second accommodation chamber is connected with a holding plate. The covering sheet, the driving head, and the holding plate are locked by using two screw bolts.

3 Claims, 7 Drawing Sheets

RATCHET HANDLE

FIELD OF THE INVENTION

The present invention relates to a ratchet handle which is capable of changing rotation direction by alternatively pressing two operation portions of a press member.

BACKGROUND OF THE INVENTION

A conventional ratchet handle contains a direction switching structure having a push button or a rotatable disc, wherein each of the push button and the rotatable disc has a retainer configured to switch a rotation direction of the ratchet handle.

However, the conventional ratchet handle cannot be operated smoothly.

The present invention has arisen to mitigate and/or obviate the afore-described disadvantages.

SUMMARY OF THE INVENTION

The primary aspect of the present invention is to provide a ratchet handle which is capable of changing rotation direction by alternatively pressing two operation portions of a press member.

To obtain above-mentioned aspect, a ratchet handle provided by the present invention contains: a body, a driving head, a first accommodation chamber and a second accommodation chamber separated by a partition, a first opening and a second opening which are formed on the partition.

A connector is housed in the second accommodation chamber and has a ratchet arranged around a peripheral wall of the connector, two actuation members are fixed behind the ratchet and includes two toothed portions formed on two front ends of the two actuation members respectively. The two actuation members are located below the first opening of the partition, the first opening accommodates a press member which has two operation portions located beside the press member respectively, two balls accommodated in the two operation portions individually, a shaft defined between the two operation portions, and a driving sheet extending downward from a center of a bottom of the press member and defined between the two actuation members.

The first accommodation chamber has a covering sheet received in the first accommodation chamber, the covering sheet includes a first orifice corresponding to the first opening of the partition, and the covering sheet includes a second orifice corresponding to the second opening of the partition, wherein an upper end of the connector extends out of the first orifice, and the press member extends out of the second orifice, the covering sheet further includes a notch defined on a center of a lower end of the second orifice so as to accommodate the shaft of the press member, two tabs arranged on two ends of the second orifice respectively, a first recess formed on a top of each of the two tabs, and a second recess formed on a bottom of each tab, wherein each of the two balls abuts against the first recess or the second recess.

Preferably, when pressing one of the two operation portions, the one operation portion moves downward, and the other operation portion moves upward, such that a ball of the other operation portion abuts against the first recess of one of the two tabs, and the other ball of the one operation portion abuts against the second recess of the other tab.

DETAILED DESCRIPTION OF THE PREFERRED EMBODIMENTS

Figure 1:
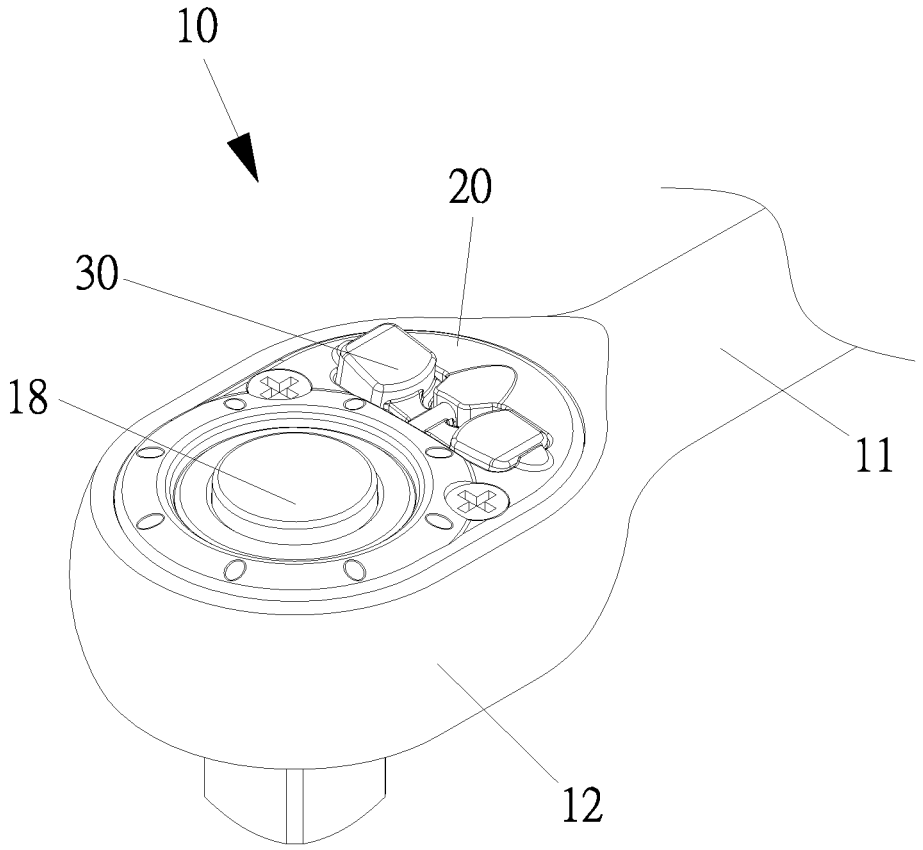
FIG. 1 is a perspective view showing the assembly of a ratchet handle according to a preferred embodiment of the present invention.
Figure 2:
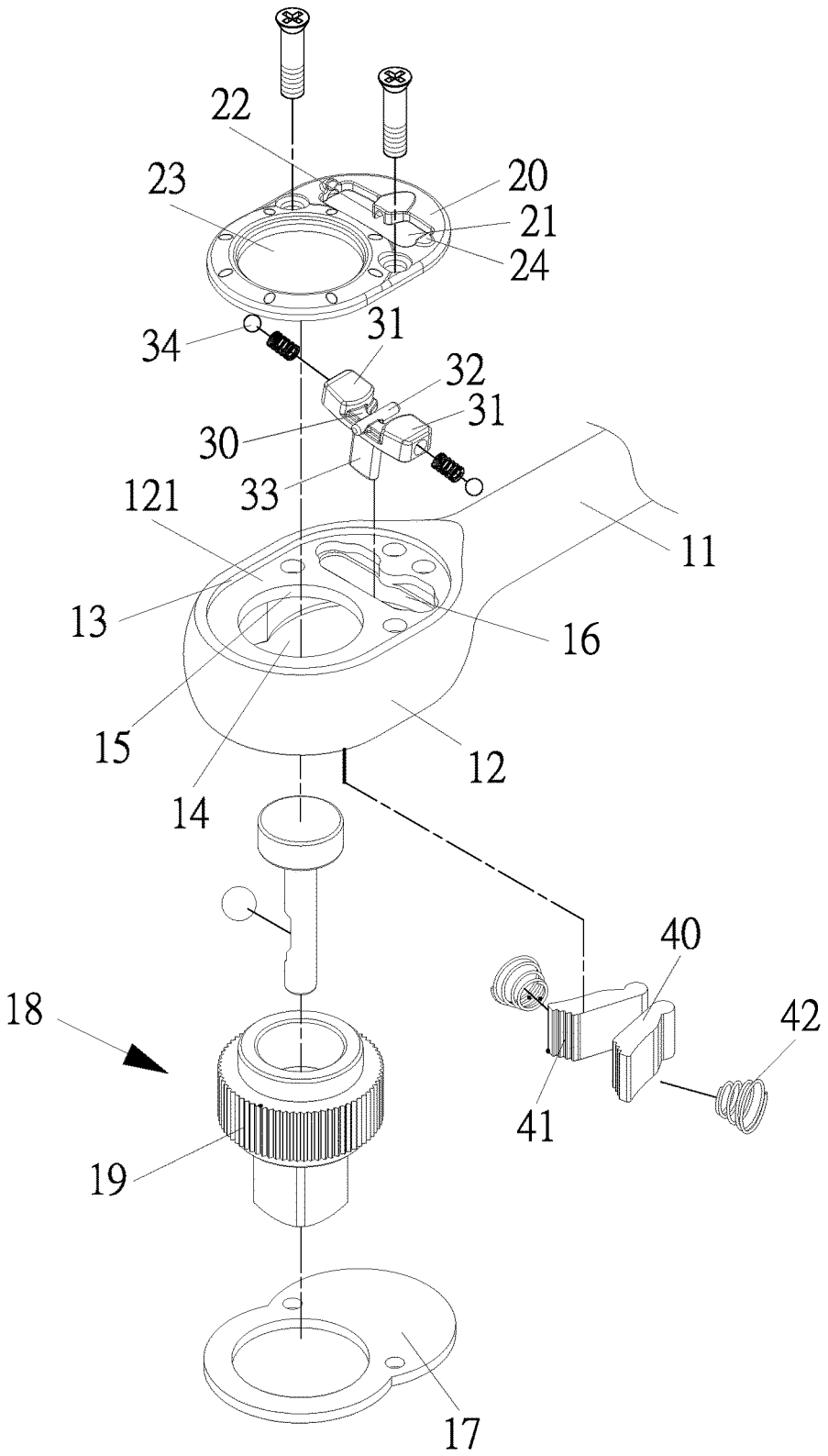
FIG. 2 is a perspective view showing the exploded components of the ratchet handle according to the preferred embodiment of the present invention.
Figure 3:
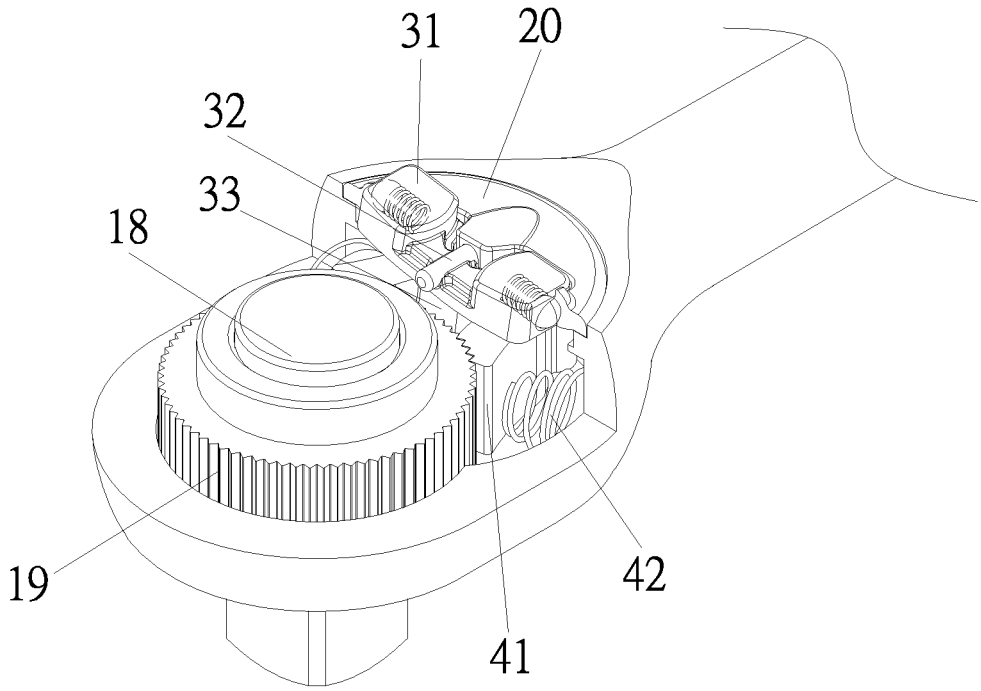
FIG. 3 is another perspective view showing the assembly of the ratchet handle according to the preferred embodiment of the present invention.
Figure 4:
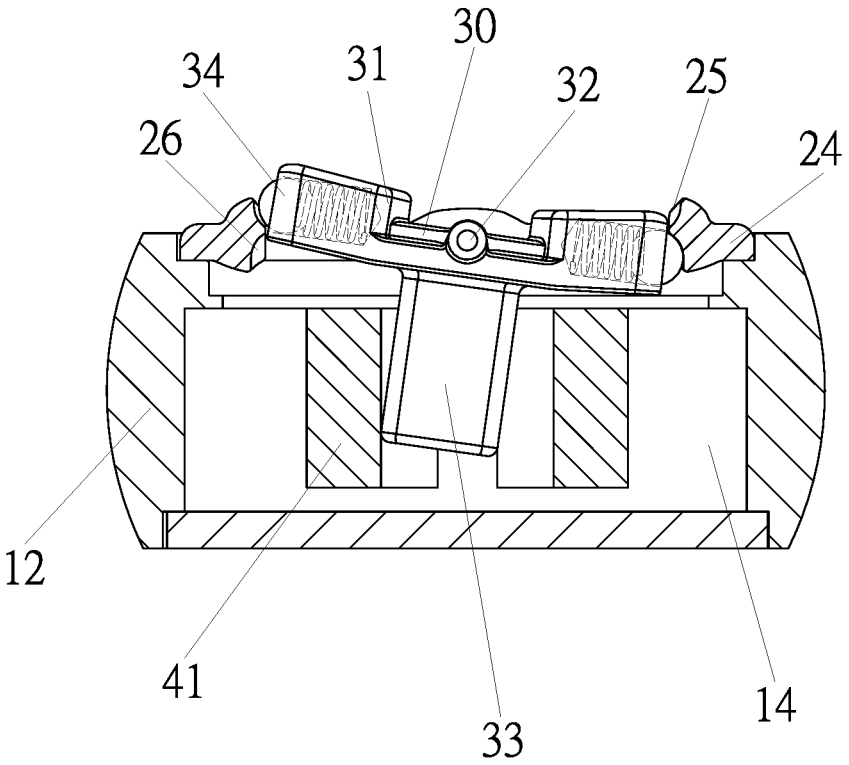
FIG. 4 is a cross sectional view showing the operation of the ratchet handle according to the preferred embodiment of the present invention.
Figure 5:
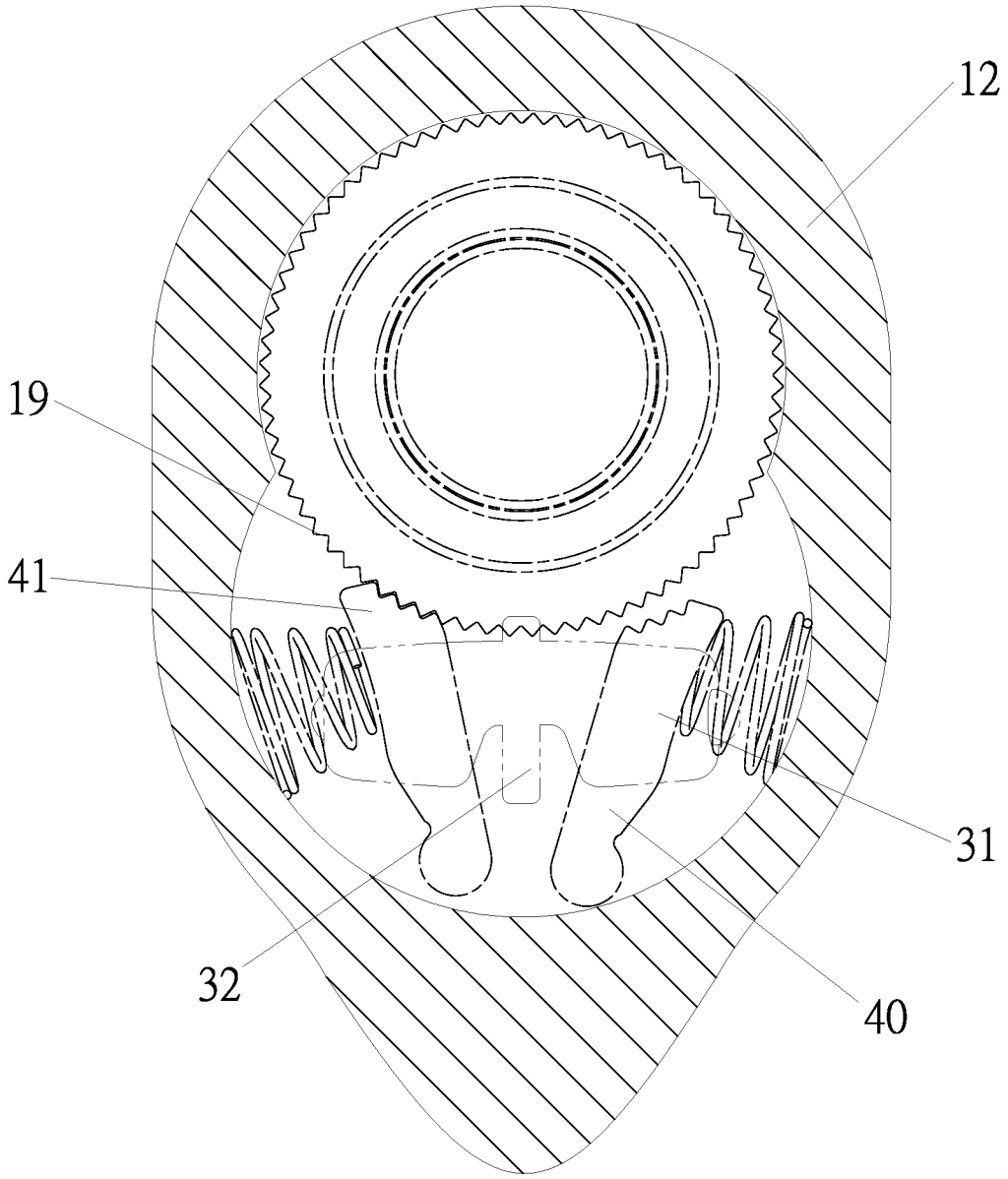
FIG. 5 is another cross sectional view showing the operation of the ratchet handle according to the preferred embodiment of the present invention.
Figure 6:
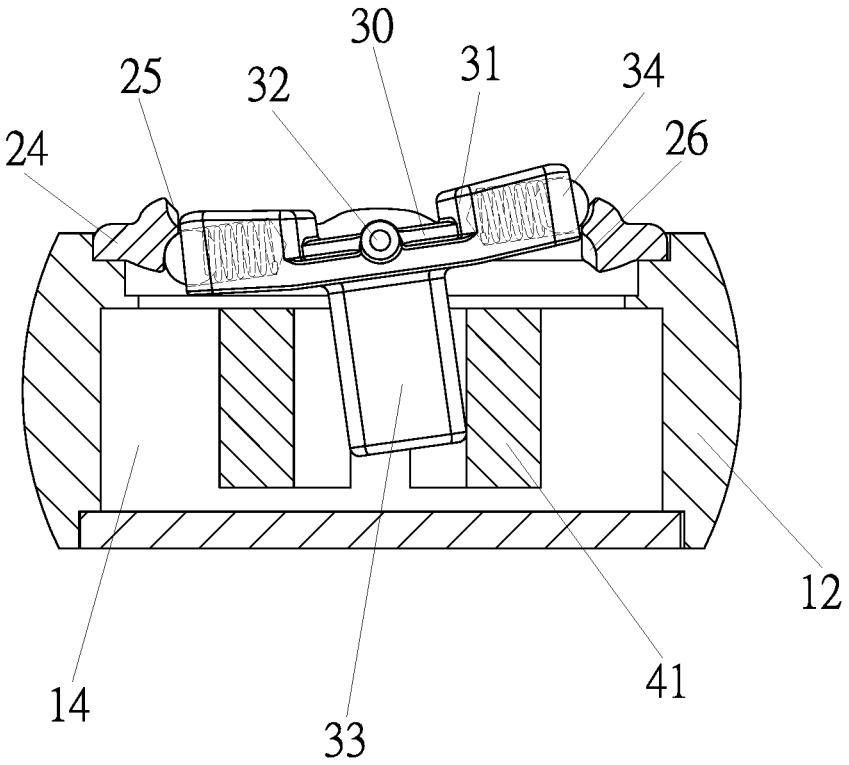
FIG. 6 is also another cross sectional view showing the operation of the ratchet handle according to the preferred embodiment of the present invention.
Figure 7:
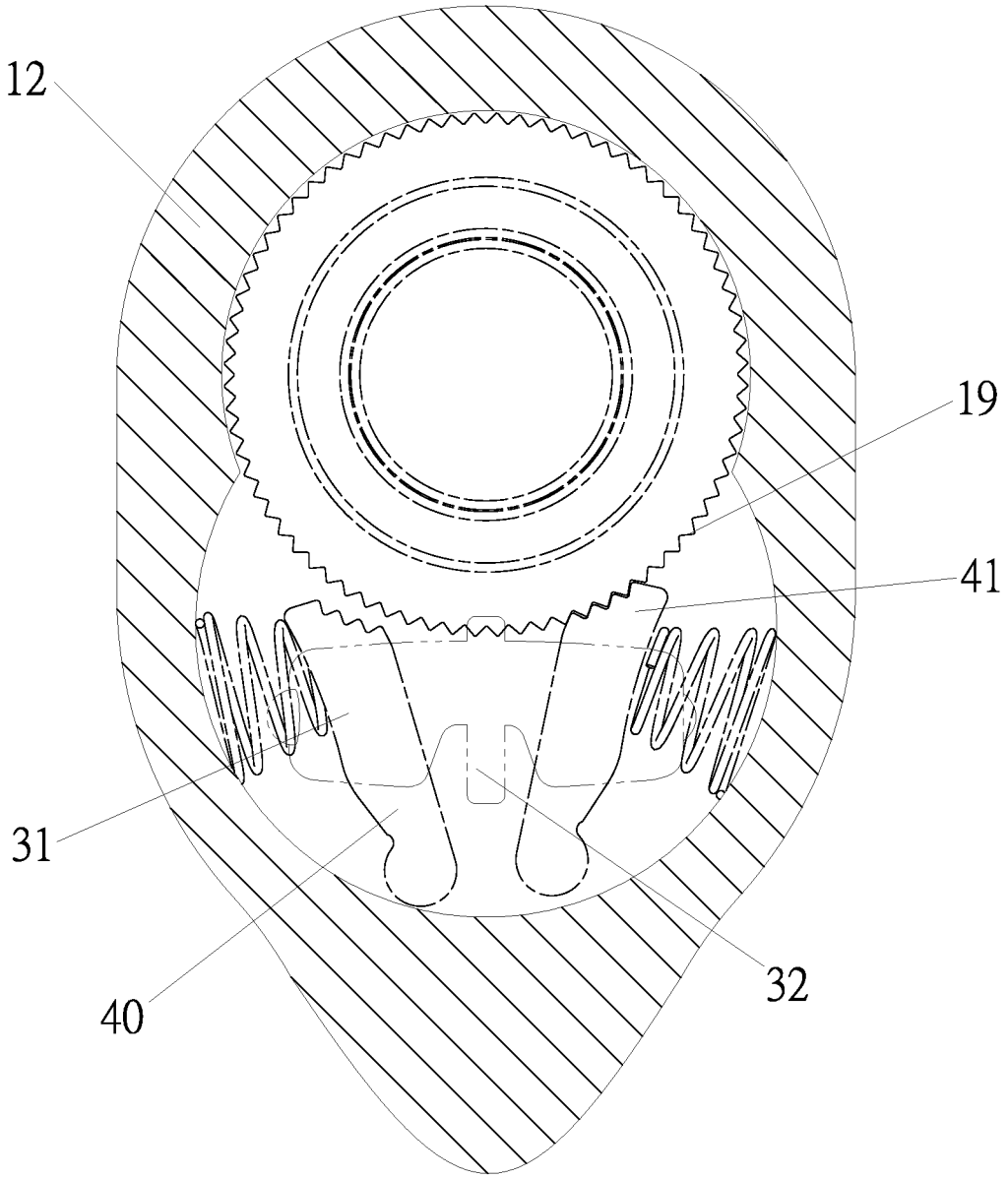
FIG. 7 is still another cross sectional view showing the operation of the ratchet handle according to the preferred embodiment of the present invention.

With reference to FIGS. 1-3, a ratchet handle 10 according to a preferred embodiment of the present invention comprises: a body 11, a driving head 12, a first accommodation chamber 13 and a second accommodation chamber 14 separated by a partition 121, a first opening 15 and a second opening 16 which are formed on the partition 121, a connector 18 housed in the second accommodation chamber 14 and having a ratchet 19 arranged around a peripheral wall of the connector 18, two actuation members 40 fixed behind the ratchet 19 and having two resilient element 42 located beside the two actuation members 40 respectively, and two toothed portions 41 formed on two front ends of the two actuation members 40 respectively.

The two actuation members 40 are located below the first opening 16 of the partition 121. The first opening 16 accommodates a press member 30 which has two operation portions 31 located beside the press member 30 respectively, two balls 34 accommodated in the two operation portions 31 individually, a shaft 32 defined between the two operation portions 31, and a driving sheet 33 extending downward from a center of a bottom of the press member 30 and defined between the two actuation members 40.

The first accommodation chamber 13 has a covering sheet 20 received therein, and a bottom of the second accommodation chamber 14 is connected with a holding plate 17, wherein the covering sheet 20, the driving head 12, and the holding plate 17 are locked by using two screw bolts.

The covering sheet 20 includes a first orifice 23 corresponding to the first opening 15 of the partition 121, and the covering sheet 20 includes a second orifice 21 corresponding to the second opening 16 of the partition 121, wherein an upper end of the connector 18 extends out of the first orifice 23, and the press member 30 extends out of the second orifice 21. The covering sheet 20 further includes a notch 22 defined on a center of a lower end of the second orifice 21 so as to accommodate the shaft 32 of the press member 30, two tabs 24 arranged on two ends of the second orifice 21 respectively, a first recess 25 formed on a top of each of the two tabs 24, a second recess 26 formed on a bottom of each tab 24, wherein each of the two balls 24 abuts against the first recess 25 or the second recess 26.

Referring further to FIGS. 4-7, when pressing one of the two operation portions 31, the press member 30 rotates along the shaft 32, the one ball 34 of the one operation portion 31 retains with the first recess 25 of one of the two tabs 24, and the other ball 24 of the other operation 31 retains with the second recess 26 of the other tab 24 so that the driving sheet 33 tilts and actuates one of the two actuation members 40 to rotate outward, hence the toothed portion 41 removes from the ratchet 19 of the connector 18, and the connector 18 abuts against the one actuation member 40, thus driving the connector 18 in one direction. When pressing the other operation portions 31 of the press member 30, the connector 18 abuts against the other actuation member 40, thus driving the connector 18 in the other direction.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A ratchet handle comprising:

a body, a driving head, a first accommodation chamber and a second accommodation chamber separated by a partition, a first opening and a second opening which are formed on the partition;

a connector housed in the second accommodation chamber and having a ratchet arranged around a peripheral wall of the connector, two actuation members fixed behind the ratchet and including two toothed portions formed on two front ends of the two actuation members respectively, the two actuation members being located below the first opening of the partition, the first opening accommodates a press member which has two operation portions located beside the press member respectively, two balls accommodated in the two operation portions individually, a shaft defined between the two operation portions, and a driving sheet extending downward from a center of a bottom of the press member and defined between the two actuation members;

the first accommodation chamber having a covering sheet received in the first accommodation chamber, the covering sheet including a first orifice corresponding to the first opening of the partition, and the covering sheet including a second orifice corresponding to the second opening of the partition, wherein an upper end of the connector extends out of the first orifice, and the press member extends out of the second orifice, the covering sheet further includes a notch defined on a center of a lower end of the second orifice so as to accommodate the shaft of the press member, two tabs arranged on two ends of the second orifice respectively, a first recess formed on a top of each of the two tabs, and a second recess formed on a bottom of each tab, wherein each of the two balls abuts against the first recess or the second recess.

2. The ratchet handle as claimed in claim 1, wherein when pressing one of the two operation portions, the one operation portion moves downward, and the other operation portion moves upward, such that a ball of the other operation portion abuts against the first recess of one of the two tabs, and the other ball of the one operation portion abuts against the second recess of the other tab.

3. The ratchet handle as claimed in claim 1, wherein a bottom of the second accommodation chamber is connected with a holding plate, and the covering sheet, the driving head, and the holding plate are locked by using two screw bolts.

* * * * *